US011680352B2

(12) United States Patent
Leibman et al.

(10) Patent No.: US 11,680,352 B2
(45) Date of Patent: Jun. 20, 2023

(54) WASHING MACHINE APPLIANCE AND ADDITIVE ASSEMBLY

(71) Applicant: Haier US Appliance Solutions, Inc., Wilmington, DE (US)

(72) Inventors: Alexander B. Leibman, Prospect, KY (US); Venkata Chakradhar Rangu, Louisville, KY (US); Kervins Petit-Bois, Louisville, KY (US); Jay Pareshbhai Shinde, Hyderabad (IN)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/501,203

(22) Filed: Oct. 14, 2021

(65) Prior Publication Data

US 2023/0122808 A1 Apr. 20, 2023

(51) Int. Cl.

| | |
|---|---|
| ***D06F 39/02*** | (2006.01) |
| ***D06F 39/12*** | (2006.01) |
| ***D06F 23/02*** | (2006.01) |

(52) U.S. Cl.

CPC ..... *D06F 39/02* (2013.01); *D06F 23/025* (2013.01); *D06F 39/12* (2013.01)

(58) Field of Classification Search

CPC ..... D06F 39/02

See application file for complete search history.

(56) References Cited

U.S. PATENT DOCUMENTS

| | | | |
|---|---|---|---|
| 3,066,520 | A | 12/1962 | Jennings |
| 2008/0072693 | A1 | 3/2008 | Kim |

FOREIGN PATENT DOCUMENTS

| | | | |
|---|---|---|---|
| CN | 208266481 | U | 12/2018 |
| EP | 391087 | A1 | 10/1990 |
| EP | 2210976 | B1 | 1/2012 |
| JP | 2008073127 | A | 4/2008 |
| KR | 100765278 | B1 | 10/2007 |
| WO | WO2010088226 | A1 | 8/2010 |

*Primary Examiner* — Jason Y Ko

(74) *Attorney, Agent, or Firm* — Dority & Manning, P.A.

(57) ABSTRACT

A washing machine appliance may include a cabinet, a tub, a wash basket, a recirculation line, and an infuser reservoir. The cabinet may include a front panel. The front panel may define an opening. The tub may be positioned within the cabinet. The wash basket may be rotatably mounted within the tub. The wash basket may define a wash chamber for receiving articles for washing. The recirculation line may define an air path in fluid communication with the tub. The recirculation line may extend from a first line end disposed on the tub to second line end disposed on the tub and spaced apart from the first line end. The infuser reservoir may be attached to the recirculation line along the air path an in fluid communication therewith.

20 Claims, 7 Drawing Sheets

WASHING MACHINE APPLIANCE AND ADDITIVE ASSEMBLY

FIELD OF THE INVENTION

The present subject matter relates generally to washing machine appliances and more particularly to additive assemblies for washing machine appliances.

BACKGROUND OF THE INVENTION

Washing machine appliances generally include a tub for containing water or wash liquid, e.g., water and detergent, bleach, and/or other wash additives. A basket is rotatably mounted within the tub and defines a wash chamber for receipt of articles for washing. During normal operation of such washing machine appliances, the wash liquid is directed into the tub and onto articles within the wash chamber of the basket. The basket or an agitation element can rotate at various speeds to agitate articles within the wash chamber, to wring wash fluid from articles within the wash chamber, etc.

In some instances, it may be desirable to provide certain objects or fluids for the aiding or enhancing the wash of articles within a dryer appliance. For instance, some users may desire additional scent modification of washed articles (e.g., beyond what is provided by traditional detergents or fabric softeners). To this end, some users may add concentrated scent pellets or oils to the basket for each new wash load. Such pellets often dissolve with water within the wash basket.

Difficulties and shortcomings exist with these existing approaches. For instance, a user is required to remember to supply pellets with each wash load. It may be difficult to know the correct or effective quantity of pellets to add for a given load. However, providing a separate measuring and dispensing assembly may increase cost and complexity of the system. Additionally, performance of the scent pellets may be compromised or hindered by the one or more rinse cycles of a single washing operation, which can, in effect, wash away the scent pellets and dilute the effects thereof.

Accordingly, a washing machine appliance having an additive assembly 200 for delivering certain additives affecting the smell or performance of fabrics would be desirable. More particularly, an additive dispensing assembly that provides a suitable additive over multiple loads (e.g., without requiring multiple moving parts or without diluting the additive through a rinse cycle) would be especially desirable.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a washing machine appliance is provided. The washing machine appliance may include a cabinet, a tub, a wash basket, a recirculation line, and an infuser reservoir. The cabinet may include a front panel. The front panel may define an opening. The tub may be positioned within the cabinet. The wash basket may be rotatably mounted within the tub. The wash basket may define a wash chamber for receiving articles for washing. The recirculation line may define an air path in fluid communication with the tub. The recirculation line may extend from a first line end disposed on the tub to second line end disposed on the tub and spaced apart from the first line end. The infuser reservoir may be attached to the recirculation line along the air path an in fluid communication therewith.

In another exemplary aspect of the present disclosure, a washing machine appliance is provided. The washing machine appliance may include a cabinet, a tub, a wash basket, a recirculation line, and an infuser reservoir. The cabinet may include a front panel. The front panel may define an opening. The tub may be positioned within the cabinet and define a centerline therethrough. The wash basket may be rotatably mounted within the tub. The wash basket may define a wash chamber for receiving articles for washing. The recirculation line may define an air path in fluid communication with the tub. The recirculation line may extend over the tub from a first line end disposed on the tub to second line end disposed on the tub and spaced apart from the first line end. The infuser reservoir may be attached to the recirculation line along the air path an in fluid communication therewith.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
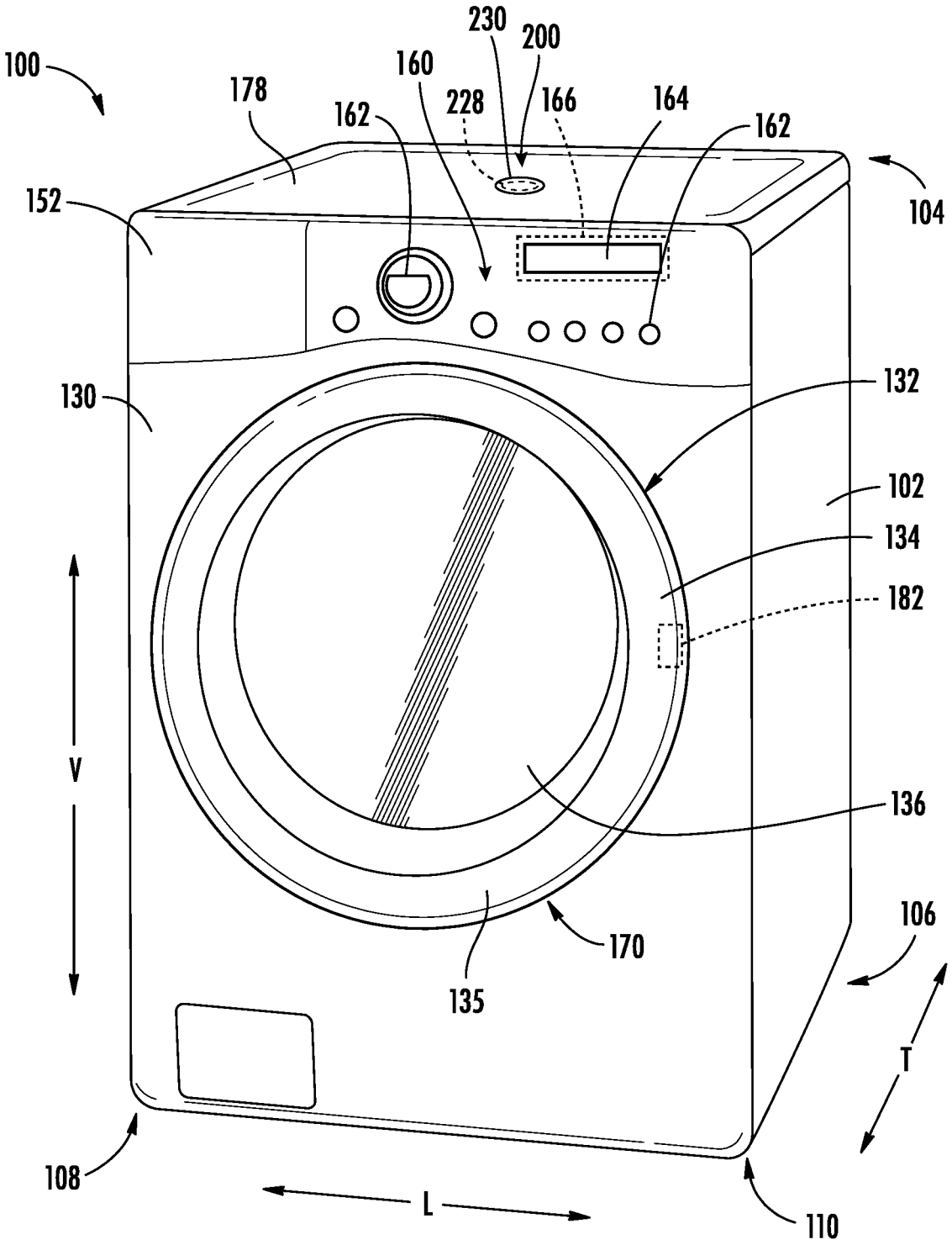
FIG. 1 provides a perspective view of a washing machine appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin (i.e., including values within ten percent greater or less than the stated value). In this regard, for example, when used in the context of an angle or direction, such terms include within ten degrees greater or less than the stated angle or direction (e.g., "generally vertical" includes forming an angle of up to ten degrees in any direction, such as, clockwise or counterclockwise, with the vertical direction V).

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
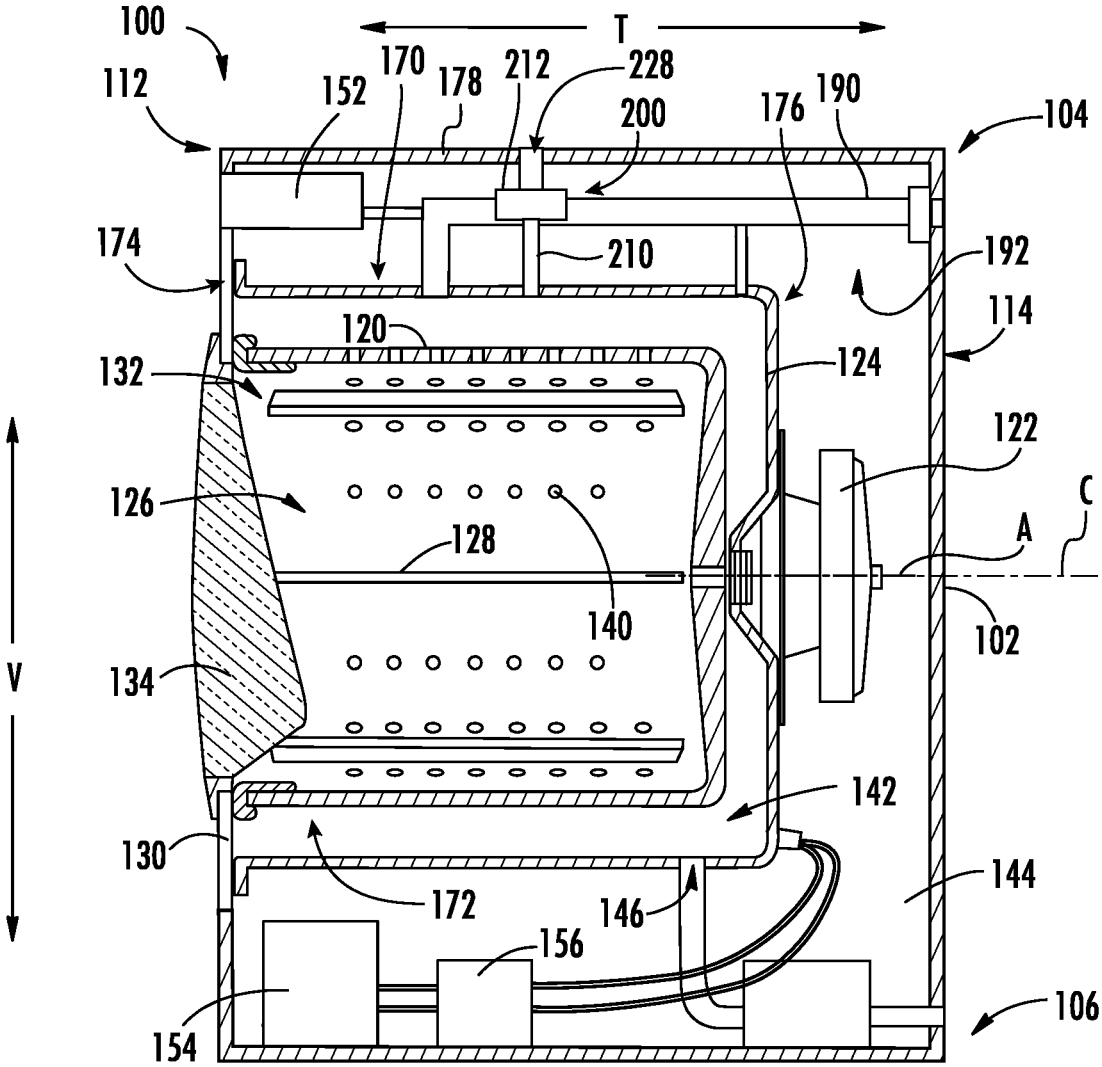
FIG. 2 provides a cross-sectional side view of the exemplary washing machine appliance of FIG. 1.
Figure 3:
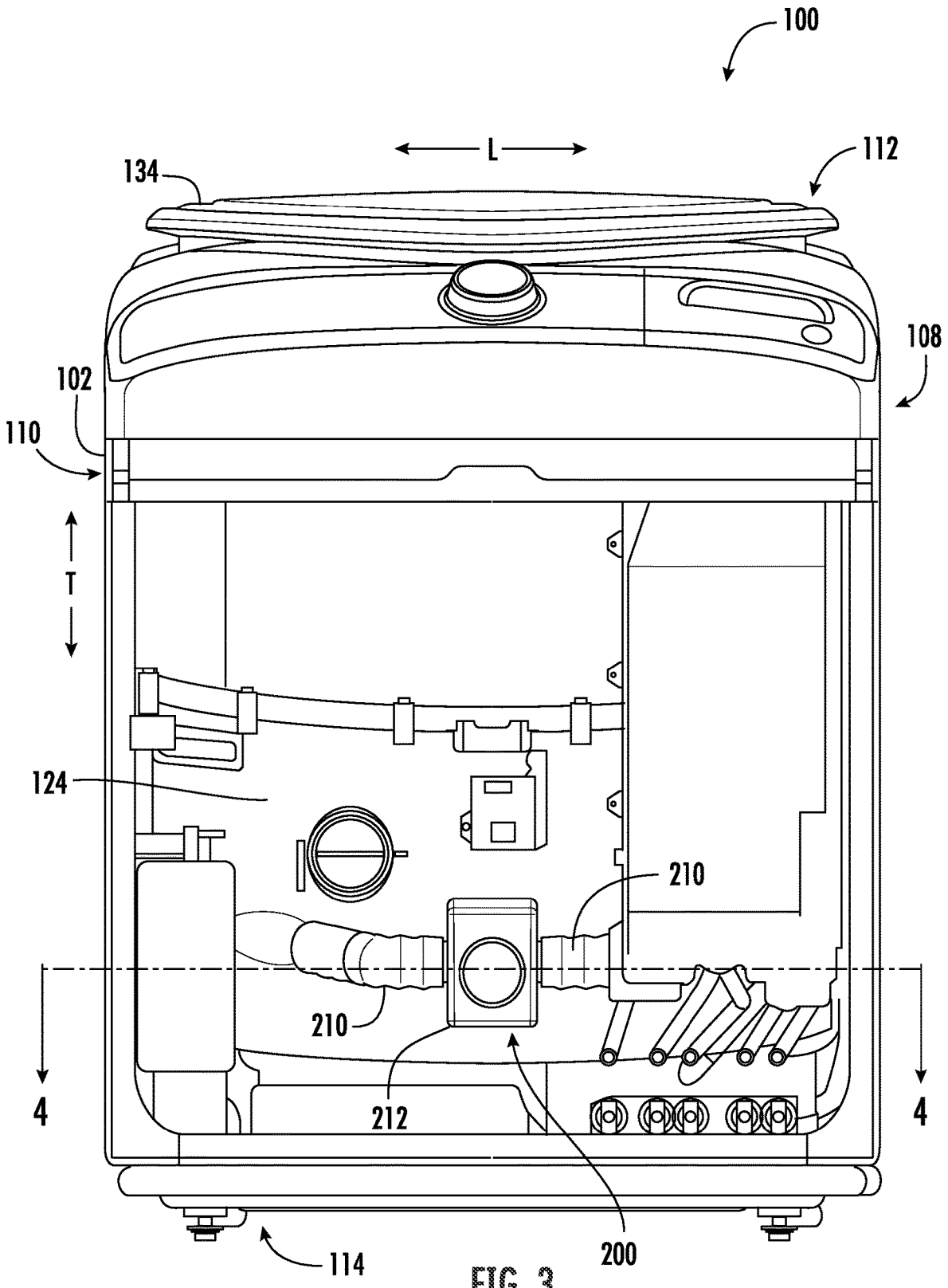
FIG. 3 provides a top plan view of the exemplary washing machine appliance of FIG. 1, wherein a top panel has been removed for clarity.
Figure 4:
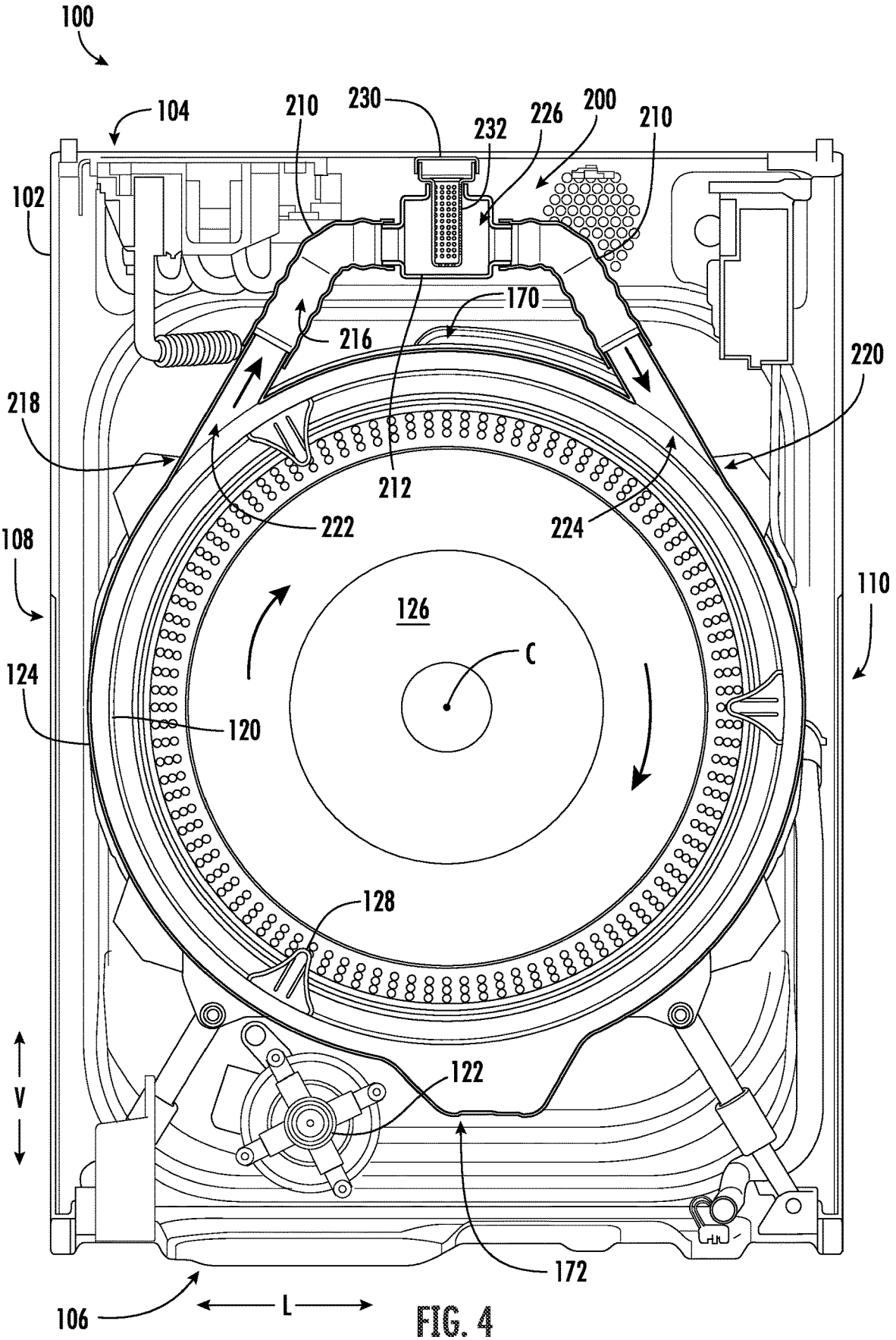
FIG. 4 provides a section view of the exemplary washing machine appliance of FIG. 3, taken along the lines 4-4.
Figure 5:
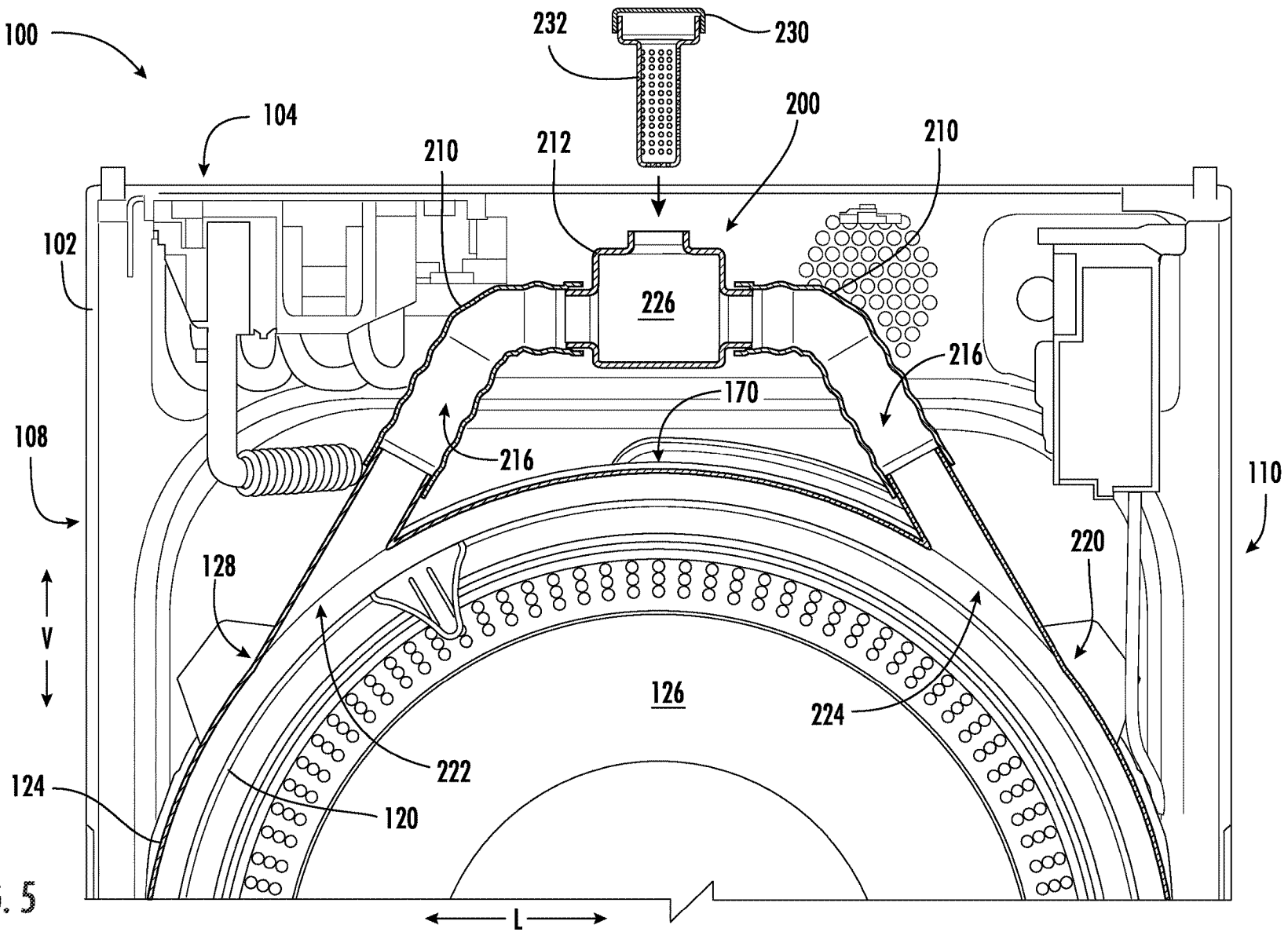
FIG. 5 provides a magnified section view of the exemplary washing machine appliance of FIG. 4, wherein an air-porous basket has been separated from an additive reservoir for clarity.
Figure 6:
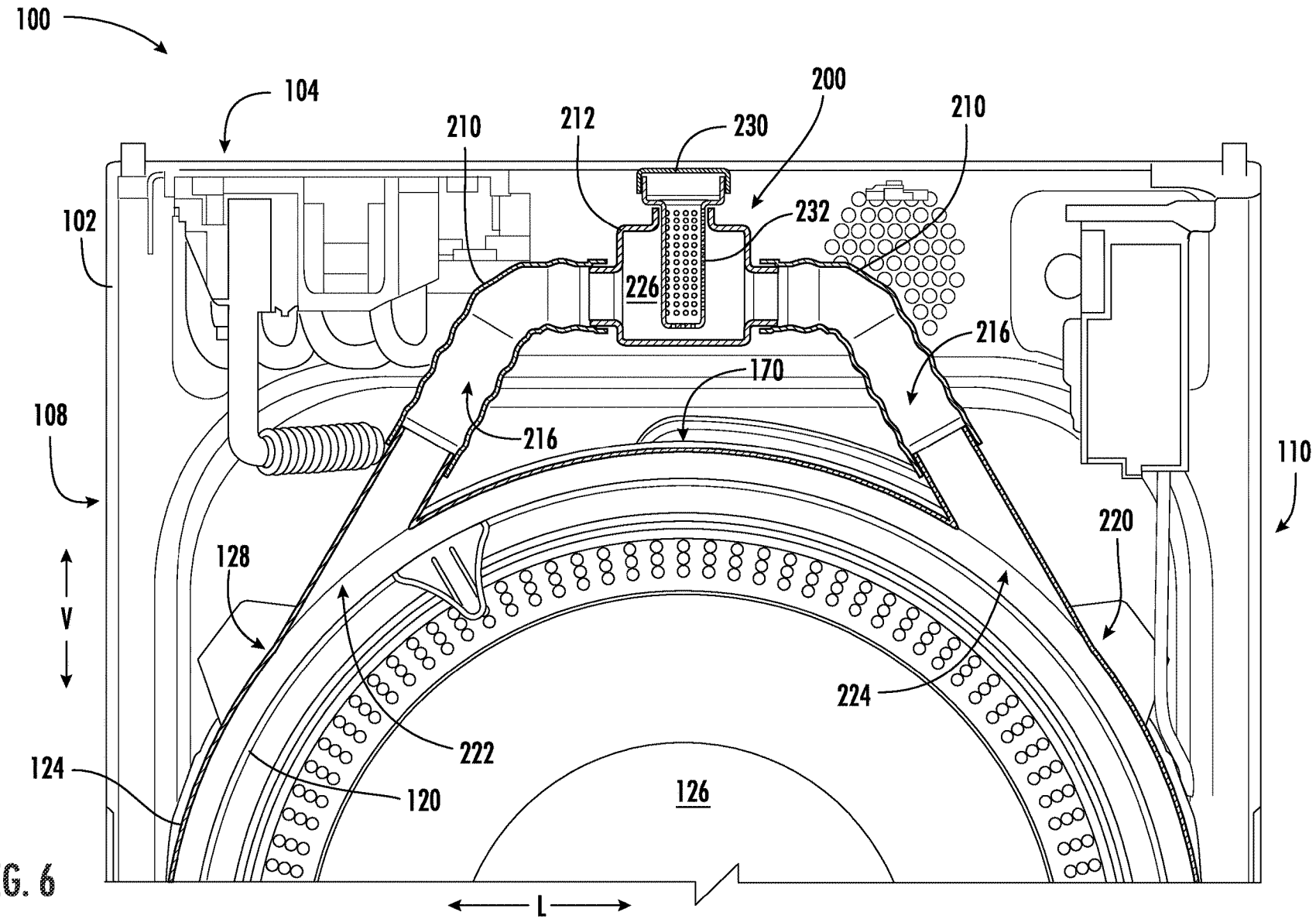
FIG. 6 provides a magnified section view of the exemplary washing machine appliance of FIG. 4.
Figure 7:
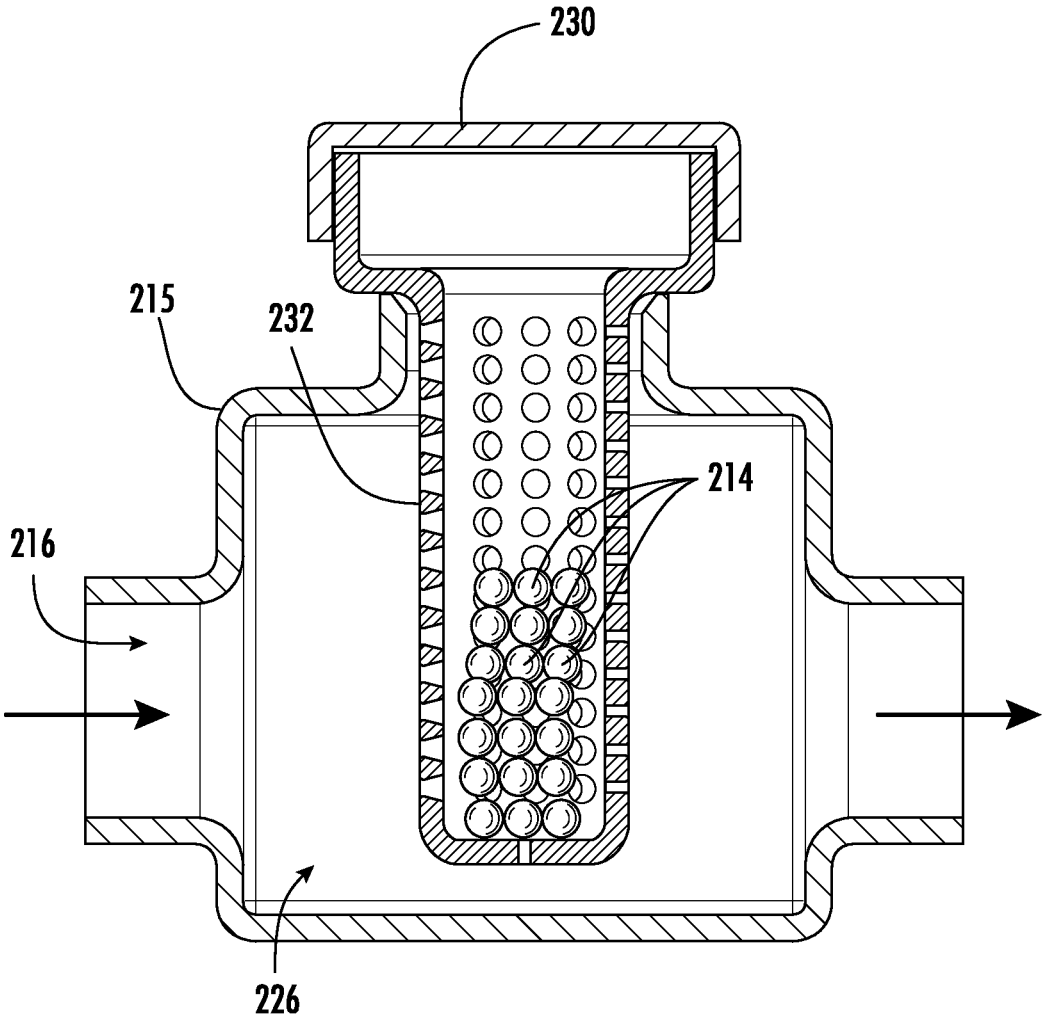
FIG. 7 provides a sectional elevation view of the additive reservoir and air-porous basket of the exemplary washing machine appliance of FIG. 4, wherein multiple additive pellets are held therein.

Referring now to the figures, FIG. 1 is a perspective view of an exemplary horizontal axis washing machine appliance 100, and FIG. 2 is a side cross-sectional view of washing machine appliance 100. As illustrated, washing machine appliance 100 generally defines a vertical direction V, a lateral direction L, and a transverse direction T, each of which is mutually perpendicular, such that an orthogonal coordinate system is defined. Washing machine appliance 100 includes a cabinet 102 that extends between a top 104 and a bottom 106 along the vertical direction V, between a left side 108 and a right side 110 along the lateral direction L, and between a front 112 and a rear 114 along the transverse direction T.

Referring to FIG. 2, a wash tub 124 is positioned within cabinet 102 and is generally configured for retaining wash fluids during an operating cycle. As used herein, "wash fluid" may refer to water, detergent, fabric softener, bleach, or any other suitable wash additive or combination thereof. Wash tub 124 is substantially fixed relative to cabinet 102 such that it does not rotate or translate relative to cabinet 102.

A wash basket 120 is received within wash tub 124 and defines a wash chamber 126 that is configured for receipt of articles for washing. More specifically, wash basket 120 is rotatably mounted within wash tub 124 such that it is rotatable about an axis of rotation A. According to the illustrated embodiments, the axis of rotation A is substantially parallel to the transverse direction T. In this regard, washing machine appliance 100 is generally referred to as a "horizontal axis" or "front load" washing machine appliance 100.

Wash basket 120 may define one or more agitator features that extend into wash chamber 126 to assist in agitation and cleaning articles disposed within wash chamber 126 during operation of washing machine appliance 100. For example, as illustrated in FIG. 2, a plurality of ribs 128 extends from basket 120 into wash chamber 126. In this manner, for example, ribs 128 may lift articles disposed in wash basket 120 during rotation of wash basket 120.

Washing machine appliance 100 includes a motor assembly 122 that is in mechanical communication with wash basket 120 to selectively rotate wash basket 120 (e.g., during an agitation or a rinse cycle of washing machine appliance 100). According to the illustrated embodiments, motor assembly 122 is a pancake motor. However, it should be appreciated that any suitable type, size, or configuration of motor may be used to rotate wash basket 120 according to alternative embodiments.

Referring generally to FIGS. 1 and 2, cabinet 102 also includes a front panel 130 that defines an opening 132 that permits user access to wash basket 120 of wash tub 124. More specifically, washing machine appliance 100 includes a door 134 that is positioned over opening 132 and is rotatably mounted to front panel 130 (e.g., about a door axis that is substantially parallel to the vertical direction V). In this manner, door 134 permits selective access to opening 132 by being movable between an open position (not shown) facilitating access to a wash tub 124 and a closed position (FIG. 1) prohibiting access to wash tub 124. Optionally, a lock assembly 182 may be fixed to cabinet 102 to selectively lock or hold a free end of the door 134 to cabinet 102 when door 134 is in the closed position (e.g., during certain operations or wash cycles).

In some embodiments, a window 136 in door 134 permits viewing of wash basket 120 when door 134 is in the closed position (e.g., during operation of washing machine appliance 100). Door 134 also includes a handle (not shown) that, for example, a user may pull when opening and closing door 134. Further, although door 134 is illustrated as mounted to front panel 130, it should be appreciated that door 134 may be mounted to another side of cabinet 102 or any other suitable support according to alternative embodiments. Additionally or alternatively, a front gasket or baffle may extend between tub 124 and the front panel 130 about the opening 132 covered by door 134, further sealing tub 124 from cabinet 102.

As shown, wash basket 120 defines a plurality of perforations 140 in order to facilitate fluid communication between an interior of basket 120 and wash tub 124. A sump 142 is defined by wash tub 124 at a bottom of wash tub 124 along the vertical direction V. Thus, sump 142 is configured for receipt of, and generally collects, wash fluid during operation of washing machine appliance 100. For example, during operation of washing machine appliance 100, wash fluid may be urged (e.g., by gravity) from basket 120 to sump 142 through plurality of perforations 140. A pump assembly 144 is located beneath wash tub 124 for gravity assisted flow when draining wash tub 124 (e.g., via a drain 146). Pump assembly 144 may also be configured for recirculating wash fluid within wash tub 124.

In some embodiments, washing machine appliance 100 includes an additive dispenser or spout 150. For example, spout 150 may be in fluid communication with a water supply (not shown) in order to direct fluid (e.g., clean water) into wash tub 124. Spout 150 may also be in fluid communication with the sump 142. For example, pump assembly 144 may direct wash fluid disposed in sump 142 to spout 150 in order to circulate wash fluid in wash tub 124.

As illustrated, a detergent drawer 152 may be slidably mounted within front panel 130. Detergent drawer 152 receives a wash additive (e.g., detergent, fabric softener, bleach, or any other suitable liquid or powder) and directs the fluid additive to wash chamber 126 during certain operations or wash cycle phases of washing machine appliance 100. According to the illustrated embodiment, detergent drawer 152 may also be fluidly coupled to spout 150 to facilitate the complete and accurate dispensing of wash additive.

In optional embodiments, a bulk reservoir 154 is disposed within cabinet 102. Bulk reservoir 154 may be configured for receipt of fluid additive for use during operation of washing machine appliance 100. Moreover, bulk reservoir 154 may be sized such that a volume of fluid additive sufficient for a plurality or multitude of wash cycles of washing machine appliance 100 (e.g., five, ten, twenty, fifty, or any other suitable number of wash cycles) may fill bulk reservoir 154. Thus, for example, a user can fill bulk reservoir 154 with fluid additive and operate washing machine appliance 100 for a plurality of wash cycles without refilling bulk reservoir 154 with fluid additive. A reservoir pump 156 is configured for selective delivery of the fluid additive from bulk reservoir 154 to wash tub 124.

In some embodiments, a ventilation line 190 190 is provided within washing machine appliance 100. In particular, ventilation line 190 190 may be enclosed within cabinet 102. For instance, as shown in FIG. 2, exemplary embodiments include ventilation line 190 190 at a position in fluid communication between tub 124 and the surrounding region (e.g., the ambient environment outside of or immediately surrounding cabinet 102, the enclosed volume of cabinet 102 surrounding tub 124, etc.). Generally, it is understood that ventilation line 190 190 may be provided as any singular or plurality of suitable pipes or conduits (e.g., having non-permeable wall) for directing air therethrough. When assembled, ventilation line 190 190 defines an air path 192 from tub 124 and within or through cabinet 102 (e.g., to the ambient environment outside of cabinet 102). In optional embodiments, air path 192 extends from the top portion of tub 124 to an upper portion of cabinet 102. However, any other suitable configuration may be provided to facilitate the flow of air from tub 124 and, for example, to the ambient environment (e.g., when washing machine appliance 100 is not in use).

In some embodiments, a control panel 160 including a plurality of input selectors 162 is coupled to front panel 130. Control panel 160 and input selectors 162 may collectively form a user interface input for operator selection of machine cycles and features. For example, in exemplary embodiments, a display 164 indicates selected features, a countdown timer, or other items of interest to machine users.

Operation of washing machine appliance 100 is generally controlled by a controller or processing device 166. In some embodiments, controller 166 is in operative communication with (e.g., electrically or wirelessly connected to) control panel 160 for user manipulation to select washing machine cycles and features. In response to user manipulation of control panel 160, controller 166 operates the various components of washing machine appliance 100 to execute selected machine cycles and features.

Controller 166 may include a memory (e.g., non-transitive memory) and microprocessor, such as a general or special purpose microprocessor operable to execute programming instructions or micro-control code associated with a wash operation. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 166 may be constructed without using a microprocessor (e.g., using a combination of discrete analog or digital logic circuitry, such as switches, amplifiers, integrators, comparators, flip-flops, AND gates, and the like) to perform control functionality instead of relying upon software. Control panel 160 and other components of washing machine appliance 100, such as motor assembly 122, may be in operative communication with controller 166 via one or more signal lines or shared communication busses. Additionally or alternatively, other features, such as an electronic lock assembly 182 for door 134 may be in operative communication with controller 166 via one or more other signal lines or shared communication busses.

In exemplary embodiments, during operation of washing machine appliance 100, laundry items are loaded into wash basket 120 through opening 132, and a wash cycle is initiated through operator manipulation of input selectors 162. For example, a wash cycle may be initiated such that wash tub 124 is filled with water, detergent, or other fluid additives (e.g., via spout 150 during a fill phase). One or more valves (not shown) can be controlled by washing machine appliance 100 to provide for filling wash basket 120 to the appropriate level for the amount of articles being washed or rinsed. By way of example, once wash basket 120 is properly filled with fluid, the contents of wash basket 120 can be agitated (e.g., with ribs 128) for an agitation phase of laundry items in wash basket 120. During the agitation phase, the basket 120 may be motivated about the axis of rotation A at a set speed (e.g., first speed or tumble speed). As the basket 120 is rotated, articles within the basket 120 may be lifted and permitted to drop therein.

After the agitation phase of the washing operation or wash cycle is completed, wash tub 124 can be drained (e.g., through a drain phase). Laundry articles can then be rinsed (e.g., through a rinse phase) by again adding fluid to wash tub 124, depending on the particulars of the wash cycle selected by a user. Ribs 128 may again provide agitation within wash basket 120. One or more spin phases may also be used. In particular, a spin phase may be applied after the wash cycle or after the rinse cycle in order to wring wash fluid from the articles being washed. During a spin phase, basket 120 is rotated at relatively high speeds. For instance, basket 120 may be rotated at one set speed (e.g., second speed or pre-plaster speed) before being rotated at another set speed (e.g., third speed or plaster speed). As would be understood, the pre-plaster speed may be greater than the tumble speed and the plaster speed may be greater than the pre-plaster speed. Moreover, agitation or tumbling of articles may be reduced as basket 120 increases its rotational velocity such that the plaster speed maintains the articles at a generally fixed position relative to basket 120.

After articles disposed in wash basket 120 are cleaned (or the wash cycle otherwise ends), a user can remove the articles from wash basket 120 (e.g., by opening door 134 and reaching into wash basket 120 through opening 132).

Turning now to FIGS. 3 through 7, an additive assembly 200 may be provided for supplying or infusing one or more additives to articles within the wash chamber 126 (e.g., separately from or in addition to detergent). As shown, additive assembly 200 may generally include a recirculation line 210 and an infuser reservoir 212 that is attached to recirculation line 210. It is understood that recirculation line 210 may be provided as any singular or plurality of suitable pipes or conduits (e.g., having non-permeable wall) for directing air therethrough and through at least a portion of infuser reservoir 212. As will be described in detail below, one or more additives (e.g., scent pellets 214) may be provided to infuser reservoir 212 to treat or affect articles within wash chamber 126 (e.g., as wash basket 120 rotates or spins).

Generally, recirculation line 210 is connected to tub 124 and defines an air path 216 in fluid communication therewith. Specifically recirculation line 210 extends from a first line end 218 to a second line end 220. As shown, first line end 218 is disposed on tub 124. For instance, first line end 218 may be mounted on tub 124. An aperture or port 222 defined through a sidewall of tub 124 may be in fluid communication (e.g., upstream fluid communication) with air path 216. Thus, air path 216 may be in fluid communication with tub 124, such as the area wash basket 120 is held within, or wash chamber 126. Optionally, a collar (e.g., defining or coaxial with the aperture or port 222 defined through the sidewall of tub 124) may be formed with or extend from an outer surface of tub 124 and provide a region or area onto which a conduit of first line end 218 may be affixed.

In some embodiments, first line end 218 is disposed above (e.g., at a higher height along the vertical direction V than) a centerline C of the tub 124. As shown, the centerline C generally extends along or parallel to the axis of rotation A for wash basket 120. Optionally, the centerline C may be substantially horizontal (e.g., perpendicular or substantially perpendicular to the vertical direction V). Additionally or alternative, centerline C may be centrally located between the top end 170 and the bottom end 172 of tub 124 along the vertical direction V. Thus, the aperture or port 222 through the sidewall of tub 124 may be defined through a portion of tub 124 that is located higher than the centerline C or axis of rotation A for wash basket 120. In some embodiments, first line end 218 is disposed at the top fourth of the tub 124 (i.e., such that about 75% of the vertical height of tub 124 is positioned below second line end 218). In certain embodiments, in addition to the vertical location or height of first line end 218, first line end 218 may be disposed on tub 124 between a front end 174 of tub 124 and a rear end 176 of tub 124. Thus, the aperture or port 222 defined by tub 124 for first line end 218 may be independent of or in addition to the front opening of the tub 124. Notably, water within tub 124 or wash basket 120 may be prevented from entering recirculation line 210 at first line end 218.

Separately from or in addition to first line end 218, second line end 220 is disposed on tub 124. For instance, second line end 220 may be mounted on tub 124. An aperture or port 224 defined through a sidewall of tub 124 may be in fluid communication (e.g., downstream fluid communication) with air path 216. Thus, air path 216 may be in fluid communication with tub 124, such as the area wash basket 120 is held within, or wash chamber 126. Moreover, a recirculation loop may be defined in which air flows from tub 124 to recirculation line 210 at first line end 218, and then back to tub 124 from recirculation line 210 at second line end 220. As shown, second line end 220 is spaced apart from second line end 220 (e.g., along the sidewall of tub 124 or along the lateral direction L). Thus, air may enter recirculation line 210 at a separate location than air returning to tub 124. Optionally, a collar (e.g., defining or coaxial with the aperture or port 224 defined through the sidewall of tub 124) may be formed with or extend from an outer surface of tub 124 and provide a region or area onto which a conduit of second line end 220 may be affixed.

In some embodiments, second line end 220 is disposed above (e.g., at a higher height along the vertical direction V than) a centerline C of the tub 124. Thus, the aperture or port 224 through the sidewall of tub 124 may be defined through a portion of tub 124 that is located higher than the centerline C or axis of rotation for wash basket 120. In some embodiments, second line end 220 is disposed at the top fourth of the tub 124 (i.e., such that about 75% of the vertical height of tub 124 is positioned below second line end 220). In certain embodiments, in addition to the vertical location or height of second line end 220, second line end 220 may be disposed on tub 124 between a front end 174 of tub 124 and a rear end 176 of tub 124. Thus, the aperture or port 224 defined by tub 124 for second line end 220 may be independent of or in addition to the front opening of the tub 124. Notably, water within tub 124 or wash basket 120 may be prevented from entering recirculation line 210 at second line end 220. In optional embodiments, the first line end 218 is disposed at a common vertical height with the second line end 220. Thus, although first and second line ends 218, 220 are spaced apart, each may be held at the same position relative to the vertical direction V on tub 124 or within cabinet 102.

In certain embodiments, recirculation line 210 is held within cabinet 102. Additionally or alternatively, recirculation line 210 may extend over the tub 124. Specifically, recirculation line 210 may extend over the tub 124 between the first line end 218 and the second line end 220. For instance, along the length of recirculation line 210, recirculation line 210 may reach upward from first line end 218 (e.g., at an angle relative to the vertical direction V) and pass over tub 124 (e.g., while remaining enclosed within cabinet 102) before leveling out or descending downward to second line end 220.

As noted above, infuser reservoir 212 is attached to recirculation line 210. Specifically, infuser reservoir 212 is attached along the air path 216 between first line end 218 and a second line end 220. Generally, infuser reservoir 212 defines a reservoir chamber 226 to communicate with tub 124. To this end, infuser reservoir 212 may be in fluid communication with air path 216. For instance, at least a portion of the air path 216 for recirculation line 210 may be joined or partially defined by the reservoir chamber 226. At least a portion of the air flowing through recirculation line 210 may, thus, be forced to pass through the reservoir chamber 226 (e.g., before returning to the tub 124). During or prior to use, a user may supply one or more additives (e.g., scent pellets 214) to infuse with or affect air flowing through infuser reservoir 212 (e.g., and recirculation line 210 prior to being returned to tub 124). In certain embodiments, an airflow can be motivated through recirculation line 210, which may be free of any dedicated fan or blower, by the rotation of wash basket 120 within wash tub 124. Advantageously, the additives may infuse the air without fully dissolving in water. Moreover, the infusion and airflow may notably occur without requiring a separate or dedicated fan or blower. Additionally or alternatively, the infusion and airflow may occur throughout a washing operation or even after a final rinse (e.g., in conjunction with rotation of the wash basket 120), advantageously ensuring the additive remains on the articles following expiration of the wash cycle.

In some embodiments, at least a portion of infuser reservoir 212 is held above tub 124. For instance, infuser reservoir 212 may be held directly above tub 124. In additional or alternative embodiments, infuser reservoir 212 is attached to or supported on cabinet 102. As an example, infuser reservoir 212 may be attached to a top panel 178 of cabinet 102. Optionally, a panel aperture 228 may be defined through cabinet 102 (e.g., at top panel 178) to permit access thereto. In turn, a user may be able to add or remove additives to reservoir chamber 226 through panel aperture 228 and from an area outside of cabinet 102. In some such embodiments, a reservoir lid 230 is selectively mounted on or otherwise received across panel aperture 228. Reservoir lid 230 may removably attach to cabinet 102 (e.g., via one or more suitable threads, snaps, clips, friction fit, etc.). A user may, in turn, mount or remove reservoir lid 230 in order to access reservoir chamber 226. Thus, reservoir lid 230 may be used to cover the panel aperture 228 (e.g., during use of washing machine appliance).

In optional embodiments, an air-porous basket 232 (e.g., mesh or solid basket defining a plurality of apertures) is provided to hold or contain additives. Specifically, air-porous basket 232 may be provided for placement within reservoir chamber 226. During use, air-porous basket 232 may thus be selectively received within infuser reservoir 212. Moreover, air-porous basket 232 may hold one or more additives (e.g., scent pellets 214) therein. As air flows through the air path 216, additives within air-porous basket 232 may be permitted to infuse the air while remaining held within wash basket 120.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance comprising:

a cabinet comprising a front panel, the front panel defining an opening;

a tub positioned within the cabinet;

a wash basket rotatably mounted within the tub, the wash basket defining a wash chamber for receiving articles for washing;

a recirculation line defining an air path in fluid communication with the tub, the recirculation line extending from a first line end disposed on the tub to second line end disposed on the tub and spaced apart from the first line end;

an infuser reservoir attached to the recirculation line along the air path an in fluid communication therewith; and an air-porous basket selectively received within the infuser reservoir.

2. The washing machine appliance of claim 1, wherein the recirculation line extends over the tub between the first line end and the second line end.

3. The washing machine appliance of claim 1, wherein the tub defines a centerline between a top end and a bottom end, and wherein the first line end is disposed above the centerline.

4. The washing machine appliance of claim 3, wherein the second line end is disposed above the centerline.

5. The washing machine appliance of claim 1, wherein the first line end is disposed at a common vertical height with the second line end.

6. The washing machine appliance of claim 1, wherein the infuser reservoir is mounted above the tub.

7. The washing machine appliance of claim 1, wherein the cabinet further comprises a top panel defining a panel aperture above the infuser reservoir to permit access thereto.

8. The washing machine appliance of claim 7, further comprising a reservoir lid selectively mounted to the top panel at the panel aperture to cover the panel aperture.

9. The washing machine appliance of claim 1, wherein the air-porous basket extends into the air path in fluid communication therewith.

10. A washing machine appliance comprising:

a cabinet comprising a front panel, the front panel defining an opening;

a tub positioned within the cabinet and defining a centerline therethrough;

a wash basket rotatably mounted within the tub, the wash basket defining a wash chamber for receiving articles for washing;

a recirculation line defining an air path in fluid communication with the tub, the recirculation line extending over the tub from a first line end disposed on the tub to second line end disposed on the tub and spaced apart from the first line end;

an infuser reservoir attached to the recirculation line along the air path an in fluid communication therewith; and an air-porous basket selectively received within the infuser reservoir.

11. The washing machine appliance of claim 10, wherein the second line end is disposed above the centerline.

12. The washing machine appliance of claim 10, wherein the first line end is disposed at a common vertical height with the second line end.

13. The washing machine appliance of claim 10, wherein the infuser reservoir is mounted above the tub.

14. The washing machine appliance of claim 10, wherein the cabinet further comprises a top panel defining a panel aperture above the infuser reservoir to permit access thereto.

15. The washing machine appliance of claim 14, further comprising a reservoir lid selectively mounted to the top panel at the panel aperture to cover the panel aperture.

16. The washing machine appliance of claim 10, wherein the air-porous basket extends into the air path in fluid communication therewith.

17. A washing machine appliance comprising:

a cabinet comprising a front panel, the front panel defining an opening;

a tub positioned within the cabinet;

a wash basket rotatably mounted within the tub, the wash basket defining a wash chamber for receiving articles for washing;

a recirculation line defining an air path in fluid communication with the tub, the recirculation line extending from a first line end disposed on a sidewall of the tub to second line end disposed on the sidewall of the tub and spaced apart from the first line end;

an infuser reservoir attached to the recirculation line along the air path an in fluid communication therewith; and a top panel defining a panel aperture above the infuser reservoir to permit access thereto.

18. The washing machine appliance of claim 17, further comprising an air-porous basket selectively received within the infuser reservoir and extending into the air path in fluid communication with the air path.

19. The washing machine appliance of claim 17, further comprising a reservoir lid selectively mounted to the top panel at the panel aperture to cover the panel aperture.

20. The washing machine appliance of claim 17, wherein the recirculation line extends over the tub between the first line end and the second line end, wherein the infuser reservoir is mounted above the tub, wherein the tub defines a centerline between a top end and a bottom end, wherein the first line end is disposed above the centerline, and wherein the second line end is disposed above the centerline.

* * * * *